US005540162A

United States Patent [19]

Schopf et al.

[11] Patent Number: 5,540,162

[45] Date of Patent: Jul. 30, 1996

[54] LOOPER DRIVE FOR A CHAIN STITCH SEWING MACHINE

[75] Inventors: Dieter Schopf, Gerlingen; Manfred Rosnitscheck, Leonberg, both of Germany

[73] Assignee: Union Special GmbH, Hemmingen, Germany

[21] Appl. No.: 353,092

[22] Filed: Dec. 9, 1994

[30] Foreign Application Priority Data

Dec. 18, 1993 [DE] Germany ..... 43 43 421.5

[51] Int. Cl.[6] ..... D05B 57/32

[52] U.S. Cl. ..... 112/220; 112/199

[58] Field of Search ..... 112/220, 199, 112/200, 202, 166, 165, 197

[56] References Cited

U.S. PATENT DOCUMENTS

| | | | |
|---|---|---|---|
| 2,884,883 | 5/1959 | Reimer | 112/200 X |
| 3,016,851 | 1/1962 | Hacklander | 112/200 |
| 3,301,207 | 1/1967 | Reeber et al. | 112/200 |
| 3,354,851 | 11/1967 | Covert | 112/200 |
| 3,460,494 | 8/1969 | Denker | 112/304 X |
| 4,599,957 | 7/1986 | Marcandalli | 112/199 |

FOREIGN PATENT DOCUMENTS

| | | | |
|---|---|---|---|
| 2156316 | 6/1972 | Germany | 112/199 |

*Primary Examiner*—Ismael Izaguirre
*Attorney, Agent, or Firm*—Brinks Hofer Gilson & Lione

[57] ABSTRACT

A looper drive for a chain stitch sewing machine that includes a flexible connection that includes an intermediate guide rod that extends between a crank arm and the looper shaft. The intermediate guide rod is mounted to pivot on the crank arm and is constructed to allow a receptacle that is carried by the looper shaft to swivel or oscillate relative thereto. The intermediate guide rod carries a ball which extends into a cylindrical-shaped opening formed in the receptacle.

12 Claims, 3 Drawing Sheets

LOOPER DRIVE FOR A CHAIN STITCH SEWING MACHINE

BACKGROUND OF THE INVENTION

The invention relates to a looper drive for a chain stitch sewing machine having at least one needle and a looper mounted on a looper shaft. The sewing machine of this invention is of the type that includes a main rotary drive shaft with cams secured thereto. A first end of a pull rod surrounds a first cam, carried by the main rotary drive shaft, and the other end of the pull rod is drivingly connected to a swivel shaft that is disposed perpendicular to the main shaft. The swivel shaft has a first drive arm that is connected to said other end of the pull rod and a second drive arm that is connected through a flexible connection to the looper shaft. The swivel shaft imparts reciprocating sliding drive to the looper shaft. The main rotary drive shaft has a second cam secured to it that is surrounded by a yoke that imparts swivel motion to the looper shaft.

U.S. Pat. No. 3,460,494 discloses a sewing machine with a looper drive in which a rotating shaft has a cam secured thereto which is surrounded by a follower which is movable perpendicular to the main shaft. The follower is flexibly connected by means of a pull rod to one arm of a crank arm which is pivotally mounted on the sewing machine housing. The crank arm is joined through its other arm by means of a swivel connection consisting of a spherical bearing to the looper shaft, which causes reciprocal movement of the looper shaft. The swivel or oscillating movement of the looper shaft is induced by means of a second cam on the rotating shaft that is surrounded by a yoke connected to the looper shaft.

Although, induction of the thrust motion to the looper shaft through the crank arm and the spherical bearing results in a simple looper drive construction, at high stitch rates, e.g., 3500 r.p.m., this swivel connection causes vibration and premature wear. The vibrations and excessive wear is a result of the mechanism for reciprocating the looper shaft. The looper shaft is reciprocated by a crank arm that rocks about a fixed pivot axis. The free end of the crank arm is connected through a spherical joint to the looper shaft for imparting reciprocating motion to the looper shaft. However, this drive also imparts an undesirable and unnecessary component of movement to the looper shaft which, especially at high speeds, renders the drive unacceptable. Furthermore, prior art looper drives including swivel connection such as this produces approximately equal looper path speeds in the region of the front or left and rear or right end position of the looper. This is disadvantageous in the formation of a chain stitch, especially in a sewing machine in which the needle lift is approximately 60 millimeters and the looper travels approximately 30 millimeters.

For the foregoing reasons, there is a need for a sewing machine having a looper drive that will not cause excess vibration or wear and can produce a better quality chain stitch.

SUMMARY OF THE INVENTION

The present invention is directed to a sewing machine that satisfies these needs. The sewing machine consists of a looper drive for the chain stitch sewing machine having at least one needle and a looper mounted on a looper shaft. The sewing machine of this invention consists of a main rotary drive shaft having multiple cams secured thereto. A first end of a pull rod surrounds a cam on the main rotary drive shaft and the other end of the pull rod is drivingly connected to a swivel shaft that is disposed perpendicular to the main shaft such that the driven swivel shaft imparts reciprocating sliding drive to the looper shaft. The swivel shaft has one drive arm that is connected to said other end of the pull rod and another drive arm that is connected, through a flexible connection including an intermediate guide rod to the looper shaft. By the use of the intermediate guide rod a compact and stable arrangement is produced which facilitates a low-vibration and low-wear drive for the looper and thus also a low-noise level when running the looper drive at high speeds.

The main rotary drive shaft has another cam secured to it that is surrounded by a yoke that imparts swivel motion to the looper shaft.

In addition the structural arrangement of the intermediate guide rod produces a decelerated looper path speed in the region of the front end position of the looper, i.e. where the sewing machine needle path crosses the looper path. Thus, the sewing reliability is increased both during the sewing on material and during chaining which is forming stitches without material.

Thus, an object of the invention is to provide an improved looper drive that can be driven at high stitch rates and there will be low vibration, low wear and an increased reliability in the formation of chain stitches.

BRIEF DESCRIPTION OF THE DRAWINGS

The following description of a preferred embodiment of the invention serves for further explanation in conjunction with the drawings in which.

DETAILED DESCRIPTION OF THE PRESENTLY PREFERRED EMBODIMENTS

Figure 1:
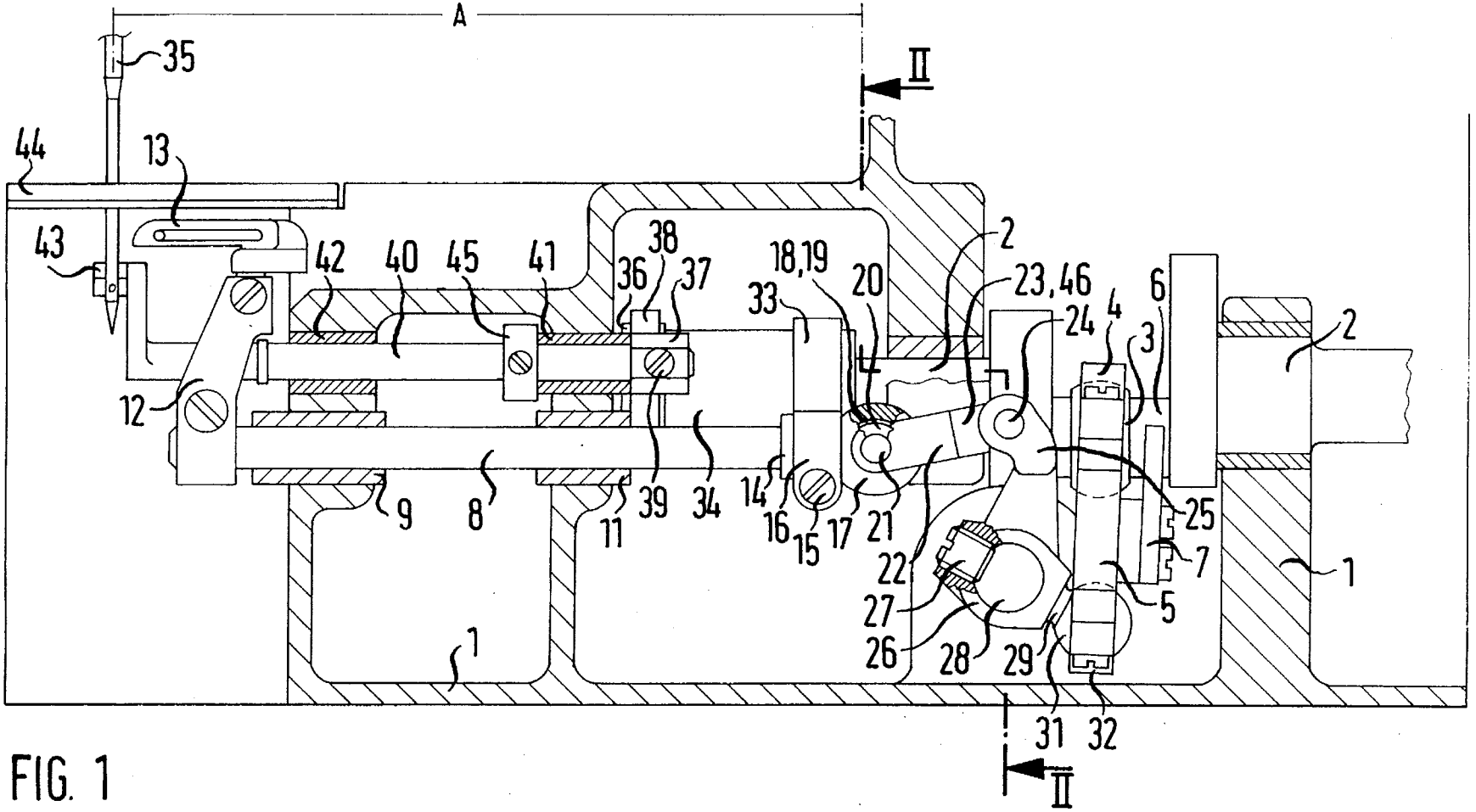
FIG. 1 is an exploded view of a portion of the front view of a sewing machine that includes the new and improved looper drive.

According to FIG. 1 the looper drive is mounted in a housing 1 in the usual way and is driven by a rotating main shaft 2 upon which there is secured a ball cam 3. The ball cam 3 is surrounded by a spherical segment 4 which is located on the end of a pull rod 5.

Alongside the ball cam 3 there is a cylindrical portion 6 which is concentric with the ball cam 3 and is surrounded by a guide fork 7 that is releasably fixed to the pull rod 5 and functions as security against tilting for the pull rod 5. Furthermore, a looper shaft 8 is mounted on the housing 1 so that it can both oscillate and slide in bushings 9 and 11 which are carried by the housing 1. The looper shaft 8 has secured to its outer end a looper holder 12 in which a looper 13 is fixed. As seen in FIG. 1 the looper 13 is disposed at its right end position.

The inner end of the looper shaft 8 protrudes into a bore 14 formed in a claw piece 16 and is fixed thereto by a screw 15. The claw piece 16 has a receptacle 17 which has a cylindrical shaped opening 19 formed therein. In the opening 19 there is positioned a ball 20 which is carried by a pin 21 which in turn is mounted in the forked end 22 of an intermediate guide rod 23. Thus, the intermediate guide rod 23 is connected to the looper shaft 8 through receptacle 17 which is disposed, through the claw piece 16, so as to swivel and slide.

The arrangement of the ball 20 in the hollow cylinder 18 facilitates in a simple manner an axial equalization of the receptacle 17 based on the swivel axis of the intermediate guide rod 23 and thus compensates for manufacturing variations in the drive parts. The intermediate guide rod 23 is pivotally connected by means of a pin 24 to a forked drive arm 25 of a crank arm 26 which is fixed by means of a screw 27 on a transverse shaft 28. The transverse shaft 28 is mounted so as to swivel or oscillate in the housing 1 and is disposed on the side opposite the looper 13 relative to the looper shaft 8. In other words, the looper shaft 8 is located between the looper 13 and the transverse shaft 28. The transverse shaft 28 is secured against axial displacement. The arrangement of the transverse shaft 28 and the construction of the crank arm 26 facilitate a passage, designated A in FIG. 1, for the housing arm which is larger than corresponding passages in the prior art. This larger passage A, which simplifies the stitching of material, is another advantage of this invention.

Crank arm 26 includes a drive arm 29 which has a ball 31 at one end. The ball 31 is surrounded by a spherical segment 32 fixed on the pull rod 5.

A yoke 33 which is disposed on the claw piece 16 surrounds a looper side path cam 34 that is fixed to the main shaft 2. When the main shaft 2 rotates a thrust motion is imposed to the looper shaft 8 through ball cam 3 and a swivel motion is imposed through the looper side path cam 34 and the yoke 33. The thrust and swivel motion of the looper shaft 8 is transmitted to the looper 13.

The intermediate guide rod 23 which is disposed so as to allow the looper shaft 8 to swivel about its axis relative thereto facilitates a decelerated movement of the looper 13 in the region of its front end position and an accelerated movement of the looper 13 in the region of its rear end position. This gives to a sewing machine needle 35 more time, during its insertion movement into the thread triangle formed by the looper 13 and by a looper thread, which results in more reliability in the stitch formation of a double chain stitch. The insertion of the needle 35 into the thread triangle takes place in the region of the front end position of the looper 13.

In addition to the looper side path cam 34 a cam 36 is fixed on the main shaft 2 which is surrounded by the fork 38 that is secured to a claw piece 37. The claw piece 37 is secured by a screw 39 to shaft 40 which is mounted, in bushings 41 and 42, to swivel or oscillate relative to the housing 1. The shaft 40 has secured to its end that emerges from the housing 1, a needle protector 43 which is disposed behind the sewing machine needle 35. Needle 35 is driven so as to move upwards and downwards and passes through the stitch plate 44. The shaft 40 is secured by means of a setting ring 45 against axial displacement. The needle protector 43 disposed on the shaft 40 prevents the sewing machine needle 35 from being deflected in the direction of advance of the material for sewing, e.g. by the material. Thus, possible collision of the looper 13 with the sewing machine needle 35, which could load to breaking of the needle, is avoided.

The intermediate guide rod 23 forms a swivel or oscillating connection 46 through which the thrust motion of the looper shaft 8 is facilitated.

Figure 2:
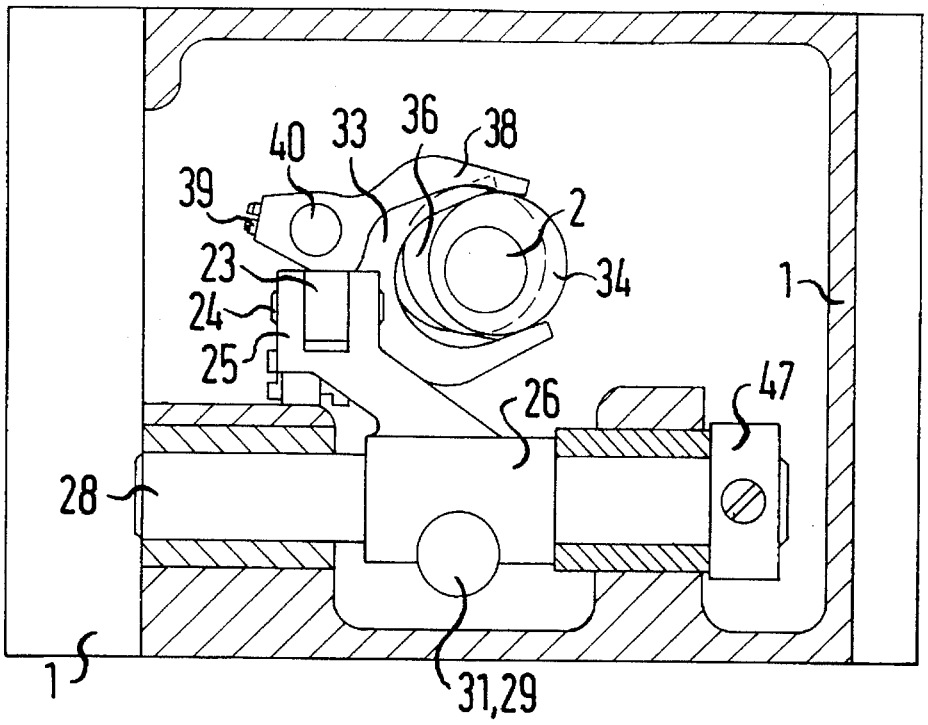
FIG. 2 is a side section view of the looper drive taken along section line II—II of FIG. 1.

FIG. 2 shows the transverse shaft 28 which in secured against axial displacement and more clearly illustrates the arrangement of the yoke 33 which partially surrounds the looper side path cam 34 and the arrangement of the fork 38 which partially surrounds the cam 36.

Figure 3:
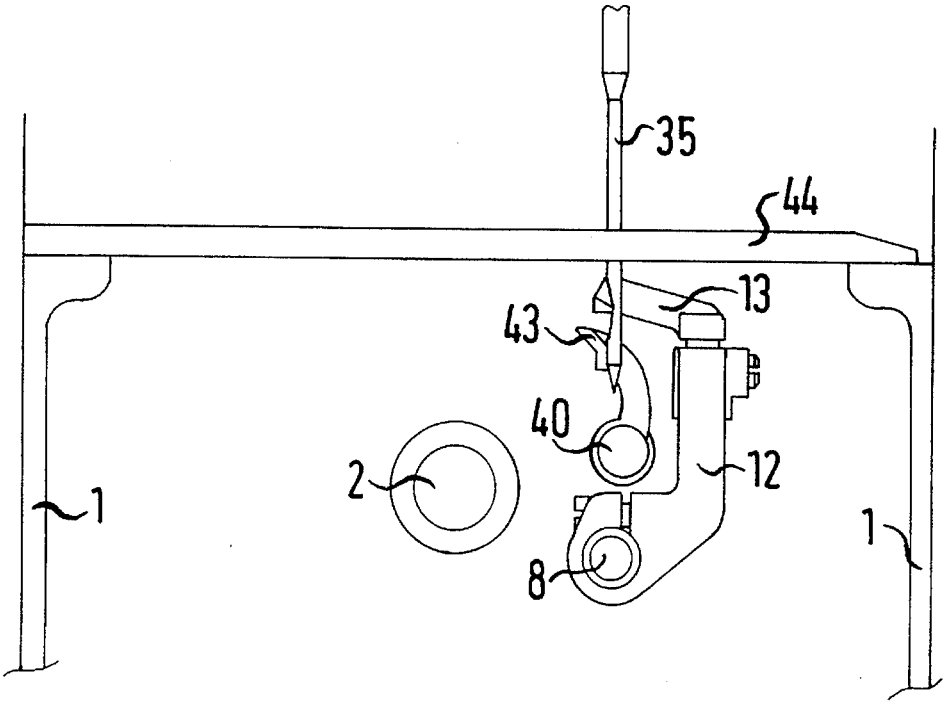
FIG. 3 is a side view of a portion of the looper drive.

FIG. 3 shows the looper drive and needle protector drive from the front. As can be seen in FIG. 3, shaft 40 of the needle protector drive is disposed above the looper shaft 8.

Figure 4:
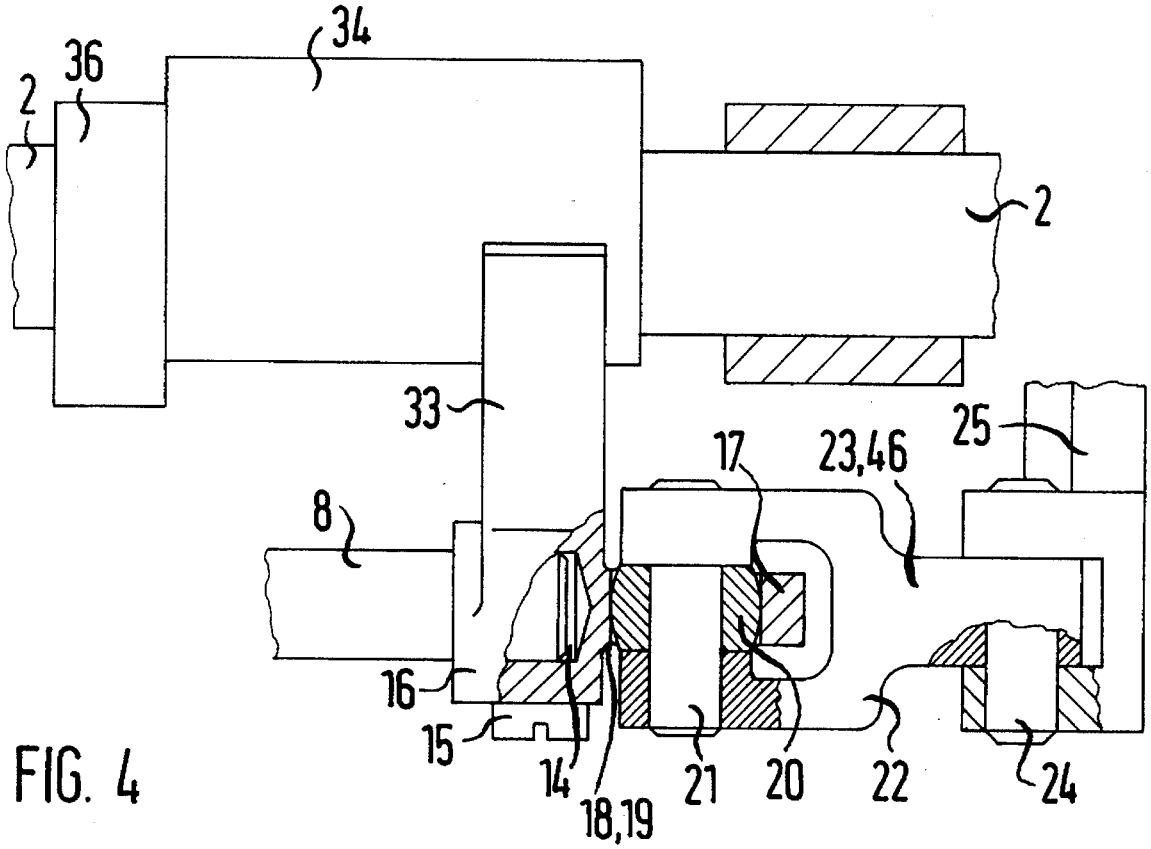
FIG. 4 is an enlarged representation of the complete swivel connection of the looper drive, viewed from above.

FIG. 4 shows the construction of the complete flexible guide and more clearly illustrates the support of the ball 20 in the hollow cylinder 18. The yoke 33, the claw piece 16, which serves as receptacle for the looper shaft 8, and the receptacle 17 are integrally constructed. This results in a compact construction of the looper drive.

We claim:

1. A looper drive for a chain stitch sewing machine of the type including a housing and further comprising at least one sewing machine needle, a sliding looper shaft, a looper carried by said looper shaft, a rotating shaft, a first cam disposed on the rotating shaft, a pull rod having ends, one end of said pull rod surrounds said first cam, a swivel shaft disposed perpendicular to said rotating shaft for imparting sliding movement to the looper shaft, a first drive arm on said swivel shaft connected to the other end of said pull rod, a second drive arm on said swivel shaft, said second drive arm including a flexible connection between the second drive arm and the looper shaft, a second cam disposed on the main shaft, a yoke surrounding said second cam for imparting swivel motion to said looper shaft, and wherein the improvement comprises:

a guide fork disposed on said pull rod that functions to prevent tilting of said pull rod; and said flexible connection between the second drive arm and the looper shaft includes an intermediate guide rod that permits said sliding looper shaft to swivel and slide.

2. Looper drive as claimed in claim 1, characterized in that said looper shaft includes a receptacle secured to its end, one end of said intermediate guide rod is pivotally connected to said second drive arm and the other end of said intermediate guide rod is mounted so as to swivel relative to said receptacle of the looper shaft.

3. Looper drive as claimed in claim 2, characterized in that there is an opening formed in said receptacle, said intermediate guide rod includes a ball which protrudes into said opening in the receptacle.

4. Looper drive as claimed in claim 3, characterized in that said opening in the receptacle is constructed as a hollow cylinder.

5. Looper drive as claimed in claim 2, characterized in that said opening in the receptacle is constructed as a hollow cylinder.

6. Looper drive as claimed in claim 2, characterized in that said yoke and said receptacle are constructed integrally.

7. A looper drive for a chain stitch sewing machine of the type including a housing and further comprising at least one sewing machine needle, a looper shaft, a looper carried by said looper shaft, a rotating shaft, a first cam disposed on the rotating shaft, a pull rod having ends, one end of said pull rod surrounds said first cam, a swivel shaft disposed perpendicular to said rotating shaft for imparting sliding movement to the looper shaft, a first drive arm on said swivel shaft connected to the other end of said pull rod, a second drive arm on said swivel shaft, said second drive arm including a flexible connection between the second drive arm and the looper shaft, a second cam disposed on the main shaft, a yoke surrounding said second cam for imparting swivel motion to said looper shaft, and wherein the improvement comprises:

said flexible connection between the second drive arm and the looper shaft including an intermediate guide rod;

said looper shaft includes a receptacle secured to its end; and one end of said intermediate guide rod is pivotally connected to said second drive arm and the other end of said intermediate guide rod is mounted so as to swivel relative to said receptacle of the looper shaft.

8. Looper drive as claimed in claim 7, characterized in that there is an opening formed in said receptacle, said intermediate guide rod includes a ball which protrudes into said opening in the receptacle.

9. Looper drive as claimed in claim 8, characterized in that said opening in the receptacle is constructed as a hollow cylinder.

10. Looper drive as claimed in claim 7, characterized in that said yoke and said receptacle are constructed integrally.

11. A looper drive for a chain stitch sewing machine of the type including a housing and further comprising at least one sewing machine needle, a looper shaft, a looper carried by said looper shaft, a rotating shaft, a first cam disposed on the rotating shaft, a pull rod having ends, one end of said pull rod surrounds said first cam, a swivel shaft disposed perpendicular to said rotating shaft for imparting sliding movement to the looper shaft, a first drive arm on said swivel shaft connected to the other end of said pull rod, a second drive arm on said swivel shaft, said second drive arm including a flexible connection between the second drive arm and the looper shaft, a second cam disposed on the main shaft, a yoke surrounding said second cam for imparting swivel motion to said looper shaft, and wherein the improvement comprises:

said flexible connection between the second drive arm and the looper shaft including an intermediate guide rod; a third cam is disposed on said rotating shaft; and a fork surrounding said third cam disposed on the rotating shaft.

12. Looper drive as claimed in claim 11, characterized in that there is a needle protector shaft journaled in the sewing machine housing, a needle protector secured to said needle protector shaft, and wherein said fork surrounding said third cam is connected to said needle protector shaft.

* * * * *